United States Patent [19]

Miller

[11] 4,155,423

[45] May 22, 1979

[54] KICK-STOOL

[76] Inventor: George C. Miller, 28 Fuchsia Rd., Primrose Hill, Germiston 1401, South Africa

[21] Appl. No.: 818,110

[22] Filed: Jul. 22, 1977

[30] Foreign Application Priority Data

Apr. 5, 1977 [ZA] South Africa ..... 76/2016

[51] Int. Cl.[2] ..... A47C 13/00; A47C 3/20

[52] U.S. Cl. ..... 182/33; 182/15; 108/12

[58] Field of Search ..... 182/33–35, 182/15; 108/13, 11, 12, 144, 148

[56] References Cited

U.S. PATENT DOCUMENTS

| | | | |
|---|---|---|---|
| 2,325,795 | 8/1943 | Pace | 182/33 |
| 3,530,954 | 9/1970 | Schmidt | 182/33 |
| 3,743,051 | 7/1973 | Cramer | 182/33 |

FOREIGN PATENT DOCUMENTS

| | | | |
|---|---|---|---|
| 51925 | 4/1910 | Switzerland | 182/33 |

*Primary Examiner*—Reinaldo P. Machado

[57] ABSTRACT

A step stool comprising a base having a top surface adapted to be located upwardly from the ground; an aperture through the top surface; an elongated support; a platform on the support, the support being movable longitudinally through the aperture between a collapsed position in which the platform lies on the top surface and an extended position in which the platform is spaced upwardly from the top surface; and engagement means on the support operative to engage the surround of the aperture on one side of the aperture with the support bearing against the surround of the aperture on the opposite side of the aperture, to retain the support in its extended position against downward force exerted on the platform.

10 Claims, 8 Drawing Figures

KICK-STOOL

This invention relates to step stools.

According to the invention a step stool comprises a base having a top surface adapted to be located upwardly from the ground; an aperture through the top surface; an elongated support; a platform on the support, the support being movable longitudinally through the aperture between a collapsed position in which the platform lies on the top surface and an extended position in which the platform is spaced upwardly from the top surface; and engagement means on the support operative to engage the surround of the aperture on one side of the aperture with the support bearing against the surround of the aperture on the opposite side of the aperture, to retain the support in its extended position against downward force exerted on the platform.

With a step stool according to the invention the platform presents a seat which may be located at either of two levels depending on whether the support is in its collapsed or extended position. Also, the step stool can be used as a step ladder with at least one step which is presented by the platform when the support is in its collapsed position and at least two steps which are presented by the top surface of the base and the platform when the support is in its extended position.

The support may be attached to the platform at an acute angle relative thereto, the support being arranged to be disposed at an angle to the vertical with the platform disposed generally parallel to the top surface of the base when the support is in its extended position.

With the arrangement of the preceding paragraph, the platform may be offset horizontally relative to the top surface to facilitate stepping from the top surface on to the platform when the support is in its extended position.

The support may be disposed at an acute angle to the top surface of the base when the support is in its collapsed position, the support being movable from its collapsed position towards its extended position by first tilting one end of the platform upwardly relative to the top surface to bring the support into a generally right angular relationship. with the top surface and thereafter moving the support upwardly through the aperture.

The aperture may comprise an elongated substantially rectangular slot in the top of the base and the support may comprise a flat strip-like element which has a cross-sectional configuration complementary to that of the slot and which is fast at one end with the platform, the support element being a relatively close fit in the slot in the direction of the width of the support element, the latter being cut away in its width in a zone located towards its end which is fast with the platform and on the side located towards the end of the platform which is initially tilted upwardly during movement of the support from its collapsed position towards its extended position, to permit movement of the support element between its collapsed and extended positions.

The engagement means on the support may comprise a notch formation in the support towards its end remote from the platform.

The step stool may include stop means operative to restrict movement of the support through the aperture and prevent complete withdrawal of the support through the aperture during movement of the support from its collapsed towards its extended position. A pair of laterally spaced supports may be provided, each support being adapted to be movable longitudinally through its own aperture through the top surface.

The base may comprise a hollow body in which the support is housed when the latter is in its collapsed position and which has a multilateral cross-sectional configuration at least in a lower region thereof, the step stool further including a mounting element which extends across each corner of the lower region of the body in a position spaced upwardly from the bottom of the lower region and which is fast with a pair of adjacent walls of the lower region meeting at the corner; a wheel resiliently mounted on each mounting element and operative to rollably support the body on the ground in spaced relationship therewith under no-load conditions and to allow the bottom of the lower region of the body to be depressed into engagement with the ground when weight is applied to the stool.

Each wheel may comprise a castor including a swivel pin on which the wheel is rotatably mounted; a mounting sleeve fast with the mounting element on the body at the corner in question, the swivel pin being rotatably located in the mounting sleeve and projecting therefrom on the side remote from the wheel; a retaining spring clip on the swivel pin towards its end projecting from the mounting sleeve; and a spring round the swivel pin in a position between the wheel and the mounting sleeve, the spring being operative resiliently to urge the wheel away from the mounting sleeve.

According to another aspect of the invention a method of producing a step stool includes the step of forming a stool base comprising a hollow body having a multilateral cross-sectional configuration at least in a lower region thereof, the hollow body being formed from a settable composition against the inner surface of a mould which is complementary to the required outer surface of the hollow body; and mounting a wheel mounting element in the hollow body across each corner thereof in a position spaced from the bottom of the lower region of the body, each mounting element being mounted by urging it into the material of a pair of adjacent walls of the lower region of the body meeting at the corner, before the settable composition from which the body is formed has set.

For a clear understanding of the invention a preferred embodiment will now be described by way of example with reference to the accompanying drawings in which.

Figure 1:
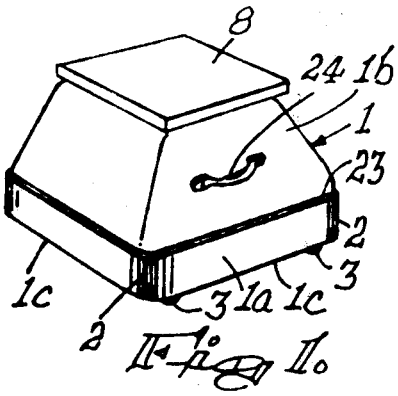
FIG. 1 is a diagrammatic perspective view from the top, of a step stool according to the invention in its collapsed condition.

Referring first to FIGS. 1 to 7, the step stool comprises base 1 comprising a hollow body which has a lower region 1*a* of rectangular cross-sectional configuration with rounded corners 2 and an upper region 1*b* of frusto-pyramidal configuration. Base 1 is provided with a resiliently mounted castor 3 at each corner 2 at the bottom of lower region 1*a*.

The upper region 1*b* of base 1 has a top surface 4 which is located upwardly from the ground 5 when base 1 is supported by castors 3 on the ground 5.

A pair of elongated, laterally spaced and substantially rectangular slots 6 are provided through the top of base 1. A flat, strip-like support 7 is located in each slot 6, each support 7 having a cross-sectional configuration complementary to that of its slot 6 so that the support is a relatively close fit in the slot in the direction of the width of the support.

Figure 3:
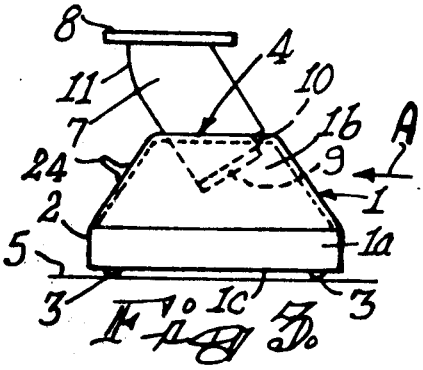
FIG. 3 is a diagrammatic side view of the step stool of FIGS. 1 and 2, showing the supports in their extended positions.

A platform 8 is attached to the two supports 7 at one end of the latter, platform 8 being located at an acute angle to supports 7 as can best be seen in FIG. 3.

A stop member 9 is secured between supports 5 at their ends remote from platform 6. An engagement notch 10 is provided in each support 7 on one side thereof at its end at which stop member 9 is attached. As can best be seen from FIGS. 2 and 3, each support element 7 is cut away in its width to a rounded configuration in the zone 11 which is located towards its end which is attached to platform 8 and on the side opposite to that in which engagement notch 10 is located. Engagement notches 10, rounded zones 11 and the upper ends of supports 7 which lie at acute angles to the longitudinal sides of the supports are important features of the stool.

Each castor 3 comprises a wheel 3*a* which is rotatably mounted on bifurcation 12 which is fast with swivel pin 13 which is rotatably located in a mounting sleeve 14. Mounting sleeve 14 is engaged in an aperture through an elongated mounting element 15 which extends across the corner 2 in question in a position spaced upwardly from the bottom edge 1*c* of lower region 1*a* of base 1 and is fast with a pair of adjacent side walls 16 (FIG. 5) of the lower region 1*a* of base 1 which meet at the corner 2.

Swivel pin 13 projects from mounting sleeve 14 on the side remote from wheel 3*a* and a retaining circlip 17 is provided on the outer end of swivel pin 13 projecting from sleeve 14. Washer 18 is provided between circlip 17 on the one hand and the upper end of mounting sleeve 14 and/or the upper surface of mounting element 15 on the other hand.

Figure 7:
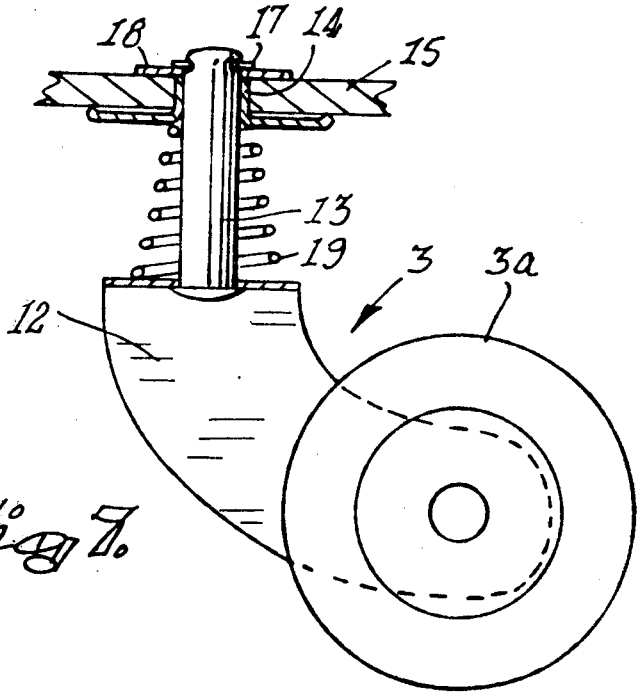
FIG. 7 is a side view to an enlarged scale of the castor wheel of FIG. 5.

Compression spring 19 is located round swivel pin 13 in a position between mounting sleeve 14 and bifurcation 12 to resiliently urge wheel 3*a* away from mounting sleeve 14 to the expanded position shown in FIG. 7 in which circlip 17 clamps washer 18 against the end of mounting sleeve 14 and/or the upper surface of mounting element 15. Circlip 17 and washer 18 facilitate free rotation of swivel pin 13 in mounting sleeve 14. Wheel 3*a* can be displaced against the action of spring 19 in the direction of mounting sleeve 14 towards a collapsed position in which spring 19 is compressed.

Under no-load conditions, castors 3 are in their expanded conditions shown in FIG. 7 and rollably support base 1 on the ground 5 with the bottom edge 1*c* of lower portion 1*a* of base 1 located in spaced relationship to ground 5, so that the step stool may be wheeled from one position to the other as required. When weight is applied to the step stool, the castors 3 are compressed against the action of springs 19 to their collapsed conditions in which base 1 is depressed so that the bottom edge 1*c* of the lower portion 1*a* of base 1 engages ground 5 to maintain the step stool in a stationary condition.

When supports 7 are in their collapsed position shown in FIG. 1, platform 8 lies on top surface 4 of base 1 and presents a seat for sitting or a step for reaching an elevated position.

Figure 2:
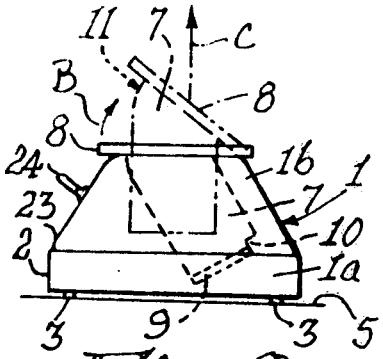
FIG. 2 is a diagrammatic side view of the step stool of FIG. 1, illustrating the initial movement of the supports of the stool from their collapsed positions towards their extended positions.

It will be seen from FIG. 2 as shown in solid lines for platform 8 and in dotted lines for supports 7, that in their collapsed position supports 7 are disposed at an acute angle to top surface 4 when platform 8 lies on top surface 4. Supports 7 are then completely housed in base 1. In view of the relatively close fit of supports 7 in their slots 6, supports 7 cannot be moved into their extended positions by lifting platform 8 directly vertically upwards, or by withdrawing supports directly in a longitudinal direction at an angle to the vertical.

As shown in FIG. 2, it is necessary first to tilt one end of platform 8 upwardly as indicated by arrow B to bring supports 7 into right angular relationship with top surface 4, whereafter supports 7 may be moved vertically upwardly through slots 6 as indicated by arrow C. The rounded zones 11 of supports 7 permit movement of the upper portions of supports 7 through slots 6 during the initial tilting movement of platform 8.

Figure 4:
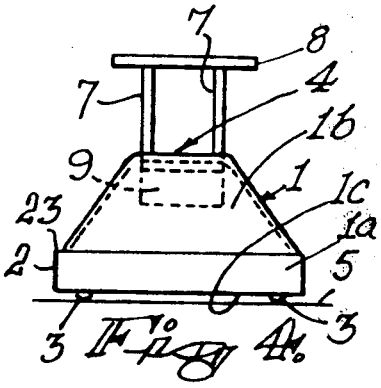
FIG. 4 is a diagrammatic end view in the direction of arrow A in FIG. 3, of the step stool with the supports in their extended positions.
Figure 5:
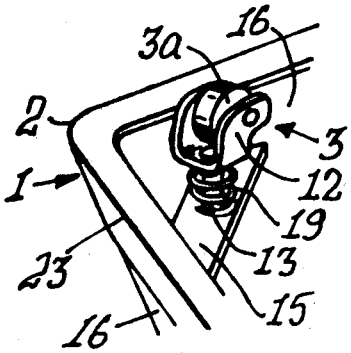
FIG. 5 is a fragmentary, diagrammatic perspective view from the bottom, of the corner of the base of the step stool showing a resiliently mounted castor.
Figure 6:
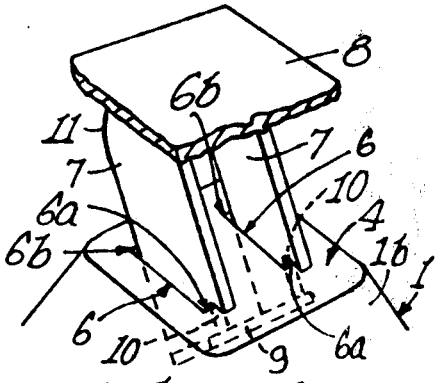
FIG. 6 is a fragmentary, diagrammatic view from the top, of the step stool with the supports in their extended positions as shown in FIGS. 3 and 4.

Supports 7 may be locked in their extended positions shown in FIGS. 3, 4 and 6 by engaging engagement notches 10 in supports 7 with the surrounds of slots 6 at one end 6*a* of the slots and allowing supports 7 to bear against the surrounds of slots 6 at the opposite ends 6*b* of the slots. Supports 7 are thus retained in their extended positions against the action of downward force exerted on platform 8. It will be seen from FIG. 3 that in the extended positions of supports 7, the supports are disposed at an angle to the vertical with platform 8 disposed substantially parallel to the top surface 4 of base 1.

In the extended positions of supports 7, platform 8 presents a seat or step at a level above that of top surface 4 of base 1. As can be seen from FIG. 3, platform 8 is off-set horizontally relative to top surface 4 to facilitate stepping from top surface 4 on to platform 8.

Stop member 9 which extends between supports 7 is adapted to engage the lower surface of the top of base 1 in the region between slots 6, to prevent complete withdrawal of supports 7 from slots 6 in an upward direction.

The component parts of the step stool may be made of any suitable material, such as chipboard and/or synthetic resinous material and/or fiberglass and/or metal. Base 1 may be injection moulded or hand moulded.

Figure 8:
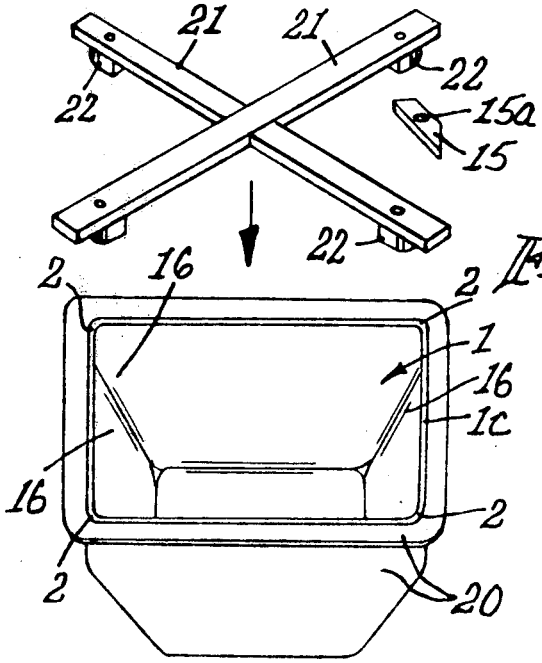
FIG. 8 is an exploded perspective view of a hollow mould with a hollow step stool base formed therein and located in inverted position, illustrating the mounting of castor mounting elements in the body across the corners thereof.

Referring to FIG. 8, hollow base 1 which is open at its bottom may be hand moulded from fibreglass or other material against the inner surface of a hollow mould 20 which is complementary in shape to that required for the outer surface of base 1. In order to mount an elongated wheel mounting element 15 (which is provided with an aperture 15*a* therethrough) across each corner 2 of the lower region 1*a* of base 1, a pair of elongated spacer holders 21 which are adapted to be located diagonally across the open end of mould 20 are provided. Each holder 21 is provided with a pair of spacer blocks 22 of a thickness equal to the required spacing of wheel mounting elements 15 from the bottom edge 1*c* of the lower region 1*a* of base 1. When holders 21 are in position on the open end of mould 20, a spacer block 22 is located in each corner of the lower region 1*a* of base 1.

Before the fibreglass from which base 1 is made has cured, a wheel mounting element 15 is placed against the downwardly directed face of each spacer block 22 in each corner of lower region 1*a* of base 1 to locate the mounting element 15 at the required spacing from bottom edge 1*c*. Each mounting element 15 is urged at opposite ends thereof into the fibreglass layers constituting a pair of adjacent walls 16 of lower region 1*a* of base 1 which meet at the corner in question. When the fibreglass has cured, each mounting element 15 is firmly secured in the material of walls 16. Each mounting element 15 may then be painted with uncured fibreglass top and bottom in the zones of entry into walls 16 to ensure firm bonding between mounting elements 15 and walls 16. Other suitable adhesive may also be used.

Wheel mounting elements 15 may be made of wood, metal, synthetic resinous material or other material. The lower region 1*a* of base 1 may be provided with a bumper strip 23 made of any suitable resilient material, such as rubber, synthetic resinous material or the like. Bumper strip 23 may be turned round the bottom edge 1*c* of lower region 1*a* of base 1 to minimize slippage when base 1 is depressed into engagement with ground 5. Bumper strip 23 may be of a distinctive colour. Platform 8 may be covered with a plastic floor tile or the like (not shown).

Base 1 may be provided with handle 24 for carrying purposes. Handle 24 is preferably located in a position such that the stool may be carried in a balanced condition like a suitcase. Instead of a handle, a gripping slot (not shown) may be provided in the wall of base 1.

What I claim is:

1. A step stool comprising a base having a top surface adapted to be located upwardly from the ground; an aperture through the top surface; an elongated support; a platform on the support, the support being movable longitudinally through the aperture between a collapsed position in which the platform lies on the top surface and an extended position in which the platform is spaced upwardly from the top surface; and engagement means on the support operative to engage the surround of the aperture on one side of the aperture with the support bearing against the surround of the aperture on the opposite side of the aperture, to retain the support in its extended position against downward force exerted on the platform.

2. A step stool as claimed in claim 1, wherein the support is attached to the platform at an acute angle relative thereto, the support being arranged to be disposed at an angle to the vertical with the platform disposed generally parallel to the top surface of the base when the support is in its extended position.

3. A step stool as claimed in claim 2, wherein the support is disposed at an acute angle to the top surface of the base when the support is in its collapsed position, the support being movable from its collapsed position towards its extended position by first tilting one end of the platform upwardly relative to the top surface to bring the support into a generally right angular relationship with the top surface and thereafter moving the support upwardly through the aperture.

4. A step stool as claimed in claim 3, wherein the support comprises a flat strip-like element which is a relatively close fit in the aperture in the direction of the width of the support element and which is fast at one end with the platform, the support element being cut away in its width in a zone located towards its end which is fast with the platform and on the side located towards the end of the platform which is initially tilted upwardly during movement of the support from its collapsed position towards its extended position, to permit movement of the support element between its collapsed and extended positions.

5. A step stool as claimed in claim 1, wherein the engagement means on the support comprises a notch formation in the support towards its end remote from the platform.

6. A step stool as claimed in claim 1, including stop means operative to restrict movement of the support through the aperture and prevent complete withdrawal of the support through the aperture during movement of the support from its collapsed towards its extended position.

7. A step stool as claimed in claim 1, including a pair of laterally spaced supports each adapted to be movable longitudinally through its own aperture through the top surface.

8. A step stool as claimed in claim 1, wherein the base comprises a hollow body in which the support is housed when the latter is in its collapsed position and which has a multilateral cross-sectional configuration at least in a lower region thereof, the step stool further including a mounting element which extends across each corner of the lower region of the body in a position spaced upwardly from the bottom of the lower region and which is fast with a pair of adjacent walls of the lower region meeting at the corner; a wheel resiliently mounted on each mounting element and operative to rollably support the body on the ground in spaced relationship therewith under no-load conditions and to allow the bottom of the lower region of the body to be depressed into engagement with the ground when weight is applied to the stool.

9. A step stool as claimed in claim 8 wherein each wheel comprises a castor including a swivel pin on which the wheel is rotatably mounted; a mounting sleeve fast with the mounting element on the body at the corner in question, the swivel pin being rotatably located in the mounting sleeve and projecting therefrom on the side remote from the wheel; a retaining spring clip on the swivel pin towards its end projecting from the mounting sleeve; and a spring round the swivel pin in a position between the wheel and the mounting sleeve, the spring being operative resiliently to urge the wheel away from the mounting sleeve.

10. A method of producing a step stool including the step of forming a stool base comprising a hollow body having a multilateral cross-sectional configuration at least in a lower region thereof, the hollow body being formed from a settable composition against the inner surface of a mould which is complementary to the required outer surface of the hollow body; and mounting a wheel mounting element in the hollow body across each corner thereof in a position spaced from the bottom of the lower region of the body, each mounting element being mounted by urging it into the material of a pair of adjacent walls of the lower region of the body meeting at the corner, before the settable composition from which the body is formed has set.

* * * * *